US008695475B2

(12) United States Patent
Schneider

(10) Patent No.: US 8,695,475 B2
(45) Date of Patent: Apr. 15, 2014

(54) SIGNATURE-REDUCED MUZZLE BRAKE

(71) Applicant: Rheinmetall Waffe Munition GmbH, Unterluess (DE)

(72) Inventor: Hubert Schneider, Dietingen (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 0 days.

(21) Appl. No.: 13/669,738

(22) Filed: Nov. 6, 2012

(65) Prior Publication Data

US 2013/0233162 A1 Sep. 12, 2013

Related U.S. Application Data

(63) Continuation of application No. PCT/EP2011/001996, filed on Apr. 19, 2011.

(30) Foreign Application Priority Data

May 6, 2010 (DE) ..... 10 2010 019 358

(51) Int. Cl.
*F41A 21/36* (2006.01)

(52) U.S. Cl.
USPC ..... 89/14.3; 42/1.06

(58) Field of Classification Search
USPC ..... 42/1.06, 78; 89/14.2, 14.4, 14.3; 181/223
See application file for complete search history.

(56) References Cited

U.S. PATENT DOCUMENTS

| | | | | |
|---|---|---|---|---|
| 1,773,443 | A * | 8/1930 | Wilman | 89/14.4 |
| 1,901,138 | A | 3/1933 | Barnes | |
| 2,065,273 | A | 12/1936 | Galliot | |
| 2,143,596 | A | 1/1939 | Galliot et al. | |
| 2,514,996 | A | 7/1950 | Faust, Jr. | |
| 3,748,956 | A * | 7/1973 | Hubner | 89/14.4 |
| 3,786,895 | A * | 1/1974 | Perrine | 181/223 |
| 4,307,652 | A | 12/1981 | Witt et al. | |
| 4,576,083 | A * | 3/1986 | Seberger, Jr. | 89/14.4 |
| 4,638,713 | A | 1/1987 | Milne et al. | |
| 4,907,488 | A * | 3/1990 | Seberger | 89/14.4 |
| 5,136,923 | A * | 8/1992 | Walsh, Jr. | 89/14.2 |
| 5,675,107 | A | 10/1997 | Ledys et al. | |
| 5,726,375 | A | 3/1998 | Adams et al. | |
| 6,298,764 | B1 | 10/2001 | Sherman et al. | |
| 6,308,609 | B1 * | 10/2001 | Davies | 89/14.4 |
| 6,575,266 | B1 * | 6/2003 | Gehse et al. | 181/223 |
| 6,899,008 | B2 | 5/2005 | Breuer | |
| 6,923,292 | B2 * | 8/2005 | Woods et al. | 181/223 |
| 7,353,741 | B2 * | 4/2008 | Brixius | 89/14.4 |

(Continued)

FOREIGN PATENT DOCUMENTS

| | | |
|---|---|---|
| DE | 650 791 | 10/1937 |
| DE | 39 40 807 A1 | 6/1991 |

(Continued)

*Primary Examiner* — Benjamin P Lee
(74) *Attorney, Agent, or Firm* — Muncy, Geissler, Olds & Lowe, P.C.

(57) ABSTRACT

A muzzle brake of a weapon or a weapons system for small- and medium-calibre weapons, that has a reduced outer signature with respect to heat and/or propellant gas emissions is provided. For this purpose, the propellant gas emerging from the barrel is diverted to the gas outlet openings of the muzzle brake in order to impinge on them to absorb the recoil, and is then made to pass further to the rear, and thereby cooled in a device.

14 Claims, 3 Drawing Sheets

(56) References Cited

U.S. PATENT DOCUMENTS

| | | | | |
|---|---|---|---|---|
| 7,516,690 | B2 * | 4/2009 | McClellan | 89/14.4 |
| 7,789,008 | B2 * | 9/2010 | Petersen | 89/14.4 |
| 7,832,323 | B1 * | 11/2010 | Davies | 89/14.4 |
| 8,196,701 | B1 * | 6/2012 | Oliver | 181/223 |
| 8,397,862 | B2 * | 3/2013 | Shand | 181/223 |
| 8,464,625 | B2 * | 6/2013 | Polovnev et al. | 89/14.2 |
| 2008/0148928 | A1 * | 6/2008 | McClellan | 89/14.4 |
| 2010/0180759 | A1 * | 7/2010 | Petersen | 89/14.4 |

FOREIGN PATENT DOCUMENTS

| | | | |
|---|---|---|---|
| DE | 297 11 207 | U1 | 10/1997 |
| DE | 696 04 097 | T2 | 1/2000 |
| DE | 10 2005 005 595 | A1 | 8/2006 |
| EP | 0 183 432 | A1 | 6/1986 |
| EP | 0 723 131 | A1 | 7/1996 |
| EP | 1 338 859 | A2 | 8/2003 |
| WO | WO 97/47939 | A1 | 12/1997 |

* cited by examiner

SIGNATURE-REDUCED MUZZLE BRAKE

This nonprovisional application is a continuation of International Application No. PCT/EP2011/001996, which was filed on Apr. 19, 2011, and which claims priority to German Patent Application No. DE 10 2010 019 358.5, which was filed in Germany on May 6, 2010, and which are both herein incorporated by reference.

BACKGROUND OF THE INVENTION

1. Field of the Invention

The invention relates to a muzzle brake of a weapon or weapon system, in particular for small-caliber and medium-caliber weapons, that has a reduced external signature with regard to heat and/or propellant gas emissions. To this end, the propellant gas emerging from the gun barrel is directed in a conventional manner onto the gas outlet openings of the muzzle brake in order to impinge thereon—to absorb the recoil—and then be guided further toward the rear and cooled in the process.

2. Description of the Background Art

Muzzle brakes have the task of deflecting to the side or the rear the powder gases that flow out in the forward direction after the passage of the projectile, thus using the combustion gases to reduce the recoil of the barrel. Immediately after the projectile has left the barrel, the pressurized combustion gases of the propellant charge emerge from the barrel, and in so doing partially strike the baffle surfaces of the muzzle brake. The combustion gases are deflected at right angles, or even slightly rearward, by the baffle surfaces, thereby transferring a part of their energy to the muzzle brake and thus to the barrel. As a result of striking the muzzle brake, the energy of the combustion gases acting in the direction of fire acts in opposition to the rearward-directed recoil, reducing it.

A muzzle brake with baffle surfaces and deflection is also known from EP 0 723 131 B1 (DE 696 04 097 T2), which corresponds to U.S. Pat. No. 5,675,107. In the opinion of the opposition division handling this patent, the cleverness of this solution resides in the fact that two muzzle brakes are combined into one new muzzle brake. How one skilled in the art would see this is questionable. In any case, the propellant gases are deflected through directed gas outlet openings onto a large baffle surface and from there to the outside.

Known from U.S. Pat. No. 4,307,652 A is a muzzle brake with rearward-deflected baffle surfaces and tubes of a scoop-like design, which are screwed onto the muzzle brake and extend almost to behind the end of the weapon. This design, too, is intended to reduce a recoil of the weapon to the greatest extent possible. For optimal recoil absorption by the muzzle brake, portions of the propellant gases also exit therefrom in the forward direction.

Known from DE 297 11 207 U1 is a recoil damper and muzzle flash suppressor in which the recoil damper is attached by a threaded joint to the recoil damper carrier, with a separator plate having multiple gas openings being located between them. In this design, the gases flow out of a reinforced part of the barrel through two laterally placed openings into the recoil damper and into the rear expansion chamber, strike the outer wall and transfer part of their heat, expand, and flow through the separator plate into the recoil damper and through its nozzles and the forward opening to the outside.

EP 1 338 859 A2, which corresponds to U.S. Pat. No. 6,899,008, which is incorporated herein by reference, relates to a gun barrel with a muzzle brake in which the gun barrel is part of the muzzle brake. This muzzle brake region is provided with openings that are covered by a casing tube provided with slot-shaped gas outlet openings.

The prior art muzzle brakes all have in common that they have a large intrinsic signature, in particular by means of heat and gas emission, so that the location of the weapon can be detected easily. This is detrimental in that with the detectability, action can be taken against the person(s) who fired the shot.

U.S. Pat. No. 2,065,273 A concerns a recoil-absorbing device for handguns. In this design, gases are deflected via nozzle openings that converge and diverge. Integrated within the device is a container with coolant that cools the deflected gases. This serves to reduce the report and protect the operator from the emitted gases. In addition, the front region of the weapon barrel is cooled.

DE 650 791, which corresponds to U.S. Pat. No. 2,143,596, discloses a gun muzzle brake or recoil-absorbing apparatus for firearms. To prevent burning and toxic gases from being able to exit rearward, a device is incorporated that can trap the gases and divert them towards the front. The openings for discharging the gases are implemented such that they force the gaseous flows to travel in a direction transverse to the axis of the weapon, so that these flows disperse under the effects of centrifugal force. For this purpose, the pitch of the helical openings is opposite to the pitch of the helical grooves of the bore of the weapon.

DE 39 40 807 C discloses a device for protection from muzzle flash effects in guns. In this design, the end region of the cannon barrel is enclosed by a jacket tube, so that an intermediate space exists between the cannon barrel and jacket tube. In the forward region of the jacket tube, a ventilation tube is attached to the jacket tube at a sufficient distance as protection from heat. The part of the ventilation tube attached to the supporting structure and the gas outlet opening, which is supported in a damped manner, can be enclosed with a heat-resistant, sound-absorbing material. A thin-walled, heat-resistant support tube with a matched contour is provided to increase the sound damping and avoid disintegration of the insulating material under shock loading. Mineral fibers are proposed as insulating material.

DE 10 2005 005 595 A1, which concerns a silencer for firearms, proposes for the silencer to additionally include the mechanism of action of a muzzle brake.

SUMMARY OF THE INVENTION

It is therefore an object of the invention to provide a muzzle brake whose intrinsic signature is reduced.

In an embodiment, the propellant gases are deflected against baffle surfaces and then guided rearward in a cooling manner, for example via a cooling medium, wherein in an embodiment, the gas is sufficiently dissipated by the cooling that no emission is to be expected, since the flow velocity of the gas is minimized and the gas loses volume through the cooling as is generally known. The return is possible as far as behind the stock or the breech.

In an embodiment, multiple cooling ribs can be provided as the cooling medium. In addition or as an alternative, these cooling ribs can also be provided with cooling materials. In the preferred variant, the cooling medium can be, for example, a mesh material, cooling fins, steel wool, a material with a honeycomb structure or honeycomb surface, for instance such as prior art shock mounts or the like, which function in a similar manner to a catalytic converter in motor vehicles.

In the simplest form, the return can take place through a number (1, 2, or n) of tubes in a manner similar to U.S. Pat.

No. 4,307,652 A, which is incorporated herein by reference. In this case, the cooling medium can be incorporated into each of these tubes.

For the return, however, provision is preferably made for a housing extension to be associated with the muzzle brake. In this design, an outer cover, through which the propellant gases can be returned—opposite the direction of flow in the gun barrel—is placed on or over the actual muzzle brake. This outer cover adjoins the housing extension that contains the cooling medium or material. The housing likewise has an outer cover and an inner cover, wherein the inner cover of the housing can be composed of, for example, the barrel guide of the gun barrel itself. The housing extension preferably is placed symmetrically about the gun barrel, with an asymmetry likewise being possible. In this case, the asymmetric shape of the housing preferably can be located below the gun barrel. In the case of unmanned operation, holes distributed over the circumference of the housing or the outer cover of the housing are also possible. The housing preferably is funnel-shaped in design, and terminates in a flange, for example. One or more openings or outlets through which the residual gas pressure can exit may be provided in this termination or in the vicinity of the end of the housing.

The transition from the outer cover of the muzzle brake to the housing of the gas return and cooling can be produced merely with incorporated cooling ribs and/or inserted cooling material. The cooling material can be incorporated in such a manner that portions thereof are located offset from one another and distributed about the gun barrel, for example. Complete filling of the housing should be avoided, but should at least be adjusted for the desired flow-through of the gas. Expansion spaces should then be created between the cooling media, which preferably are spaced apart from one another or relative to one another.

For the purpose of supporting and defined cooling of the gas, at least one opening, through which fresh air can be aspirated into the expansion space(s), is provided in the forward region of the housing. As a result of the flow velocity of the gases emerging from the muzzle brake, an underpressure arises between the opening and the expansion space, and this underpressure causes ambient air/fresh air to be aspirated. In addition, a fan can be incorporated at the back end if there is a desire to support aeration and cooling of the cooling elements. This variant has the further advantage that any possible explosion of the concentrated gases during the subsequent firing burst should be prevented.

The muzzle brake, for its part, includes a base body with bored holes. These bores are angled forward and have an oblique shape, preferably conical. Matched to these bores is a deflecting sleeve with bores through which the propellant gases can be directed rearward. The outer cover is then attached over the two bodies; this outer cover, in turn, stands in operative connection with the housing extension.

By means of the proposed design, an attenuated muzzle flash is achieved, the production of smoke is minimized, and noise is reduced, while the function of the muzzle brake is preserved. The muzzle brake thus not only takes on the function of recoil minimization, but also that of a silencer.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
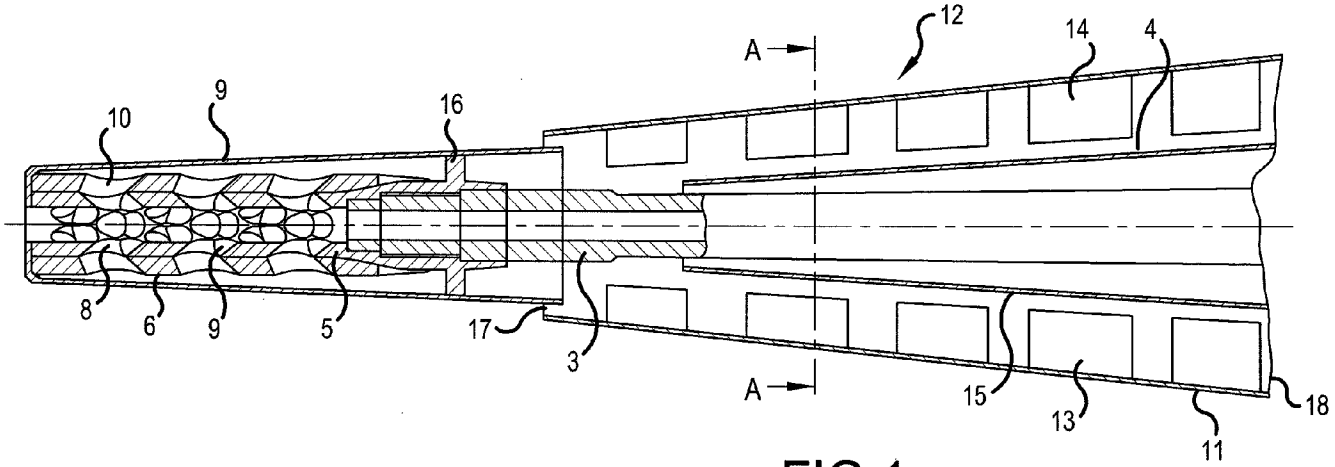
FIG. 1 is a cross-sectional representation of a muzzle brake according to the invention with gas-reducing device.
Figure 2:
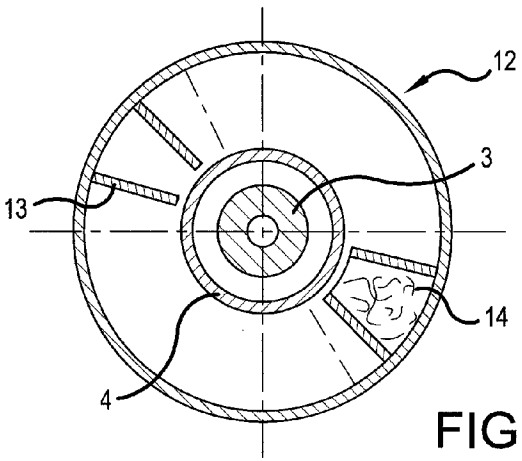
FIG. 2 is a cross-sectional representation A-A from FIG. 1, FIGS. 3 and 4 are alternatives for incorporating the gas-reducing device in a weapon.

In a cross-sectional representation, FIG. 1 shows a muzzle brake 1 with a jacket 2, which can be attached to a gun barrel 3, for example by means of a screw fitting. In this exemplary embodiment, the gun barrel 3 is enclosed by a barrel mount 4.

The muzzle brake 1 is composed of a base sleeve 5, a deflecting sleeve 6, and a jacket tube 7. Taper bores 8 in the base sleeve 5 have bevels 9 so that the propellant gases can exit better. Taper bores 10 in the deflecting sleeve 6 provide for better expansion in the jacket tube 7. The bores 8, 10 have an oblique shape—becoming larger toward the outside in each case, similar to a taper bore—since this shape can depressurize the gas, so that a first cooling already takes place at this point. The two bores 8, 10 are matched to one another.

Adjoining the jacket tube 7 is a gas-reducing device 12, which in the simplest form can be a simple outer tube (not shown in detail). According to the concept of the invention, an additional cooling component (13, 14) for cooling the propellant gases that are deflected rearward is then located in said tube.

However, the present exemplary embodiment employs (can, but need not) a weapon-independent outer cover 11 as a component of the gas-reducing device 12. Cooling ribs 13 and/or cooling material 14 are incorporated within this outer cover 11. The outer cover 11 is preferably funnel-shaped in this exemplary embodiment. This shape suggests itself when the returned gas must cool off over only a short distance. The shaping of the outer cover itself is freely selectable, however, and can be adapted to the applicable design concept.

The device 12 for reducing the gas temperature and thus the gas volume has an inner cover 15 in addition to the outer cover 11. This inner cover 15 can be an independent unit. However, on account of the bulk and the associated weight, the barrel mount 4 is incorporated as the inner cover 15. In this case, the outer cover 11, with the cooling ribs 13 or cooling material 14 attached thereto, is slid over the inner cover 15 and the device 12 is closed at the back end.

Function is as follows:

The propellant gases generated by the shot are deflected by the taper bores 8 of the base sleeve 5 onto the deflecting sleeve 6. The base sleeve 5 and the shape of the bores 8 have already dissipated the gas that then strikes the bores 10 of the deflecting sleeve 6 and is deflected in the process. The gas is then guided rearward by the jacket 7 and a muzzle flash is reduced or eliminated entirely, since an emergence of the gas does not take place in the vicinity of the muzzle brake 1.

A further cooling then takes place, for example when the propellant gases are discharged into the adjoining outer sleeve 11 through cooling ribs 16 between the muzzle brake 1 and the device 12. These cooling ribs 16 (as well as the cooling ribs 13 of the device 12) additionally function as supporting ribs and stabilize the system. At least two—but preferably four—cooling ribs 16 are provided.

The propellant gas is sucked into the device 12, for which purpose it preferably has at least one opening 17 in the front region and preferably has at least one additional opening 18 in the back region. The propellant gas drawn into the device 12 by the underpressure is sucked through the device 12, so that cooling of the gas takes place. Possible residual gas can exit through the outlet opening(s) 18 at the end of the device 12. However, this gas is then cooled sufficiently that it is no longer recognizable as such, even from afar.

Figure 3:
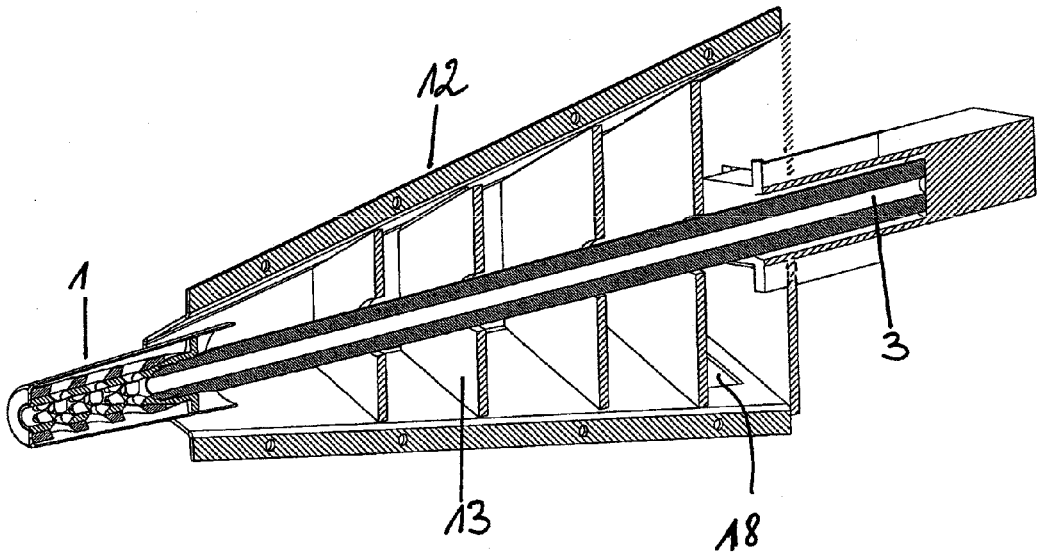
Figure 4:
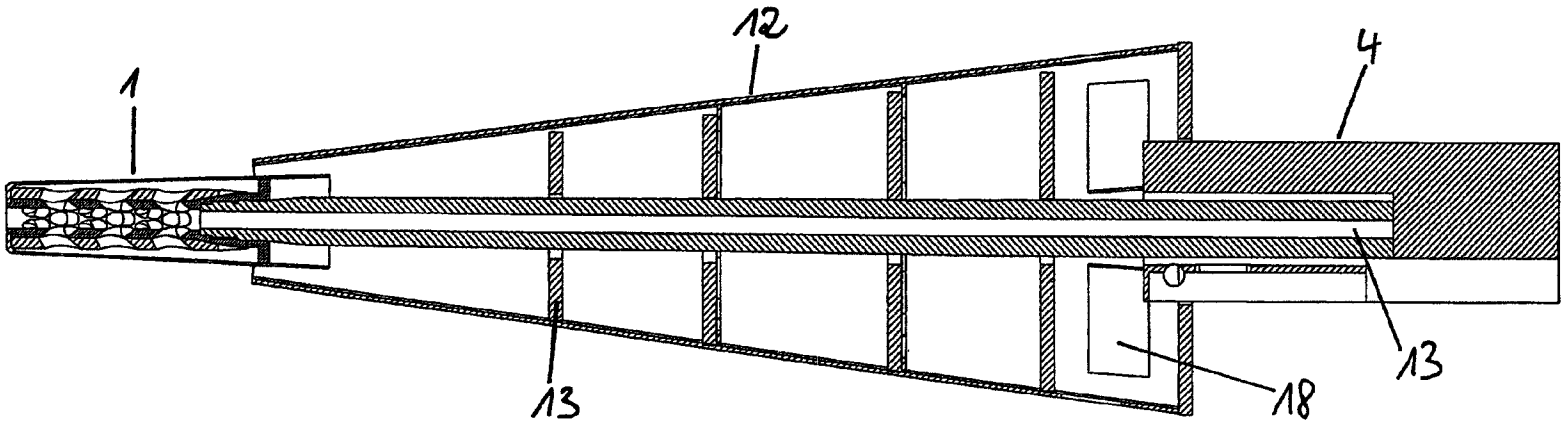

FIGS. 3 and 4 show a somewhat schematic representation of an alternative incorporation of the device 12 on the gun barrel 3 between the barrel mount 4 and the actual muzzle brake 1. The cooling ribs 13 here are incorporated facing toward the gun barrel 3. Here, too, cooling material 14 can be introduced between the cooling ribs 13.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A muzzle brake for a gun barrel comprising:

a base sleeve with bores;

a deflecting sleeve with bores;

a jacket tube arranged around the base sleeve and the deflecting sleeve for diverting the propellant gas into at least one adjoining device having cooling elements, wherein cooling ribs and/or a cooling component are provided as cooling elements; and the at least one adjoining device having at least one outer cover into which the cooling elements are incorporated, wherein the deflecting sleeve surrounds an outer surface of the base sleeve, so as to encase the base sleeve therein.

2. The muzzle brake according to claim 1, wherein the bores are oblique or conical.

3. The muzzle brake according to claim 1, wherein the bores of the base sleeve have a bevel.

4. A muzzle brake for a gun barrel comprising:

a base sleeve with bores;

a deflecting sleeve with bores;

a jacket tube arranged around the base sleeve and the deflecting sleeve for diverting the propellant as into at least one adjoining device having cooling elements, wherein cooling ribs and/or a cooling component are provided as cooling elements; and the at least one adjoining device having at least one outer cover into which the cooling elements are incorporated, wherein the cooling component is comprised of honeycomb-shaped materials, and wherein the honeycomb-shaped materials are shock mounts that are configured to function as a catalytic converter.

5. The muzzle brake according to claim 1, wherein the at least one adjoining device has an inner cover in addition to the outer cover, between which the cooling elements are incorporated.

6. The muzzle brake according to claim 5, wherein the inner cover is formed by a barrel mount of the gun barrel.

7. The muzzle brake according to claim 1, wherein an underpressure is created in the at least one adjoining device through a front opening.

8. The muzzle brake according claim 1, wherein the outer cover has a funnel shape.

9. The muzzle brake according to claim 1, wherein the at least one adjoining device is terminated by a flange, and wherein one or more openings are provided in the flange and/or in the vicinity of the end of the at least one adjoining device.

10. The muzzle brake according to claim 1, wherein a fan is incorporated at a back end of the at least one adjoining device.

11. The muzzle brake according to claim 1, wherein the cooling component is a mesh material, a cooling fin, steel wool, a material with a honeycomb structure or a honeycomb surface.

12. The muzzle brake according to claim 1, wherein the at least one adjoining device is located upstream of the base sleeve and the deflecting sleeve in a direction of travel of a projectile ejected from the gun barrel.

13. The muzzle brake according to claim 1, wherein the bores of the base sleeve are aligned with the bores of the deflecting sleeve.

14. The muzzle brake according to claim 1, further comprising additional cooling ribs provided within the jacket tube.

* * * * *